United States Patent [19]

Fish

[11] Patent Number: 5,018,491

[45] Date of Patent: May 28, 1991

[54] AUXILIARY OIL PUMPING AND DRAINING SYSTEM

[76] Inventor: Robert D. Fish, 12682 Senda Acantilada, San Diego, Calif. 92128

[21] Appl. No.: 348,950

[22] Filed: May 8, 1989

[51] Int. Cl.[5] ..... F01M 1/00

[52] U.S. Cl. ..... 123/196 S; 123/196 A

[58] Field of Search ..... 123/196 A, 196 S

[56] References Cited

U.S. PATENT DOCUMENTS

| | | | |
|---|---|---|---|
| 2,838,039 | 6/1958 | Smith et al. | 123/196 S |
| 2,889,821 | 6/1959 | Maki | 123/196 S |
| 4,168,693 | 9/1979 | Harrison | 123/196 S |
| 4,561,395 | 12/1985 | McMullon | 123/196 A |
| 4,676,206 | 6/1987 | DeGrazia, Jr. | 123/196 A |
| 4,700,670 | 10/1987 | Schade | 123/196 A |
| 4,724,806 | 2/1988 | Hartwig | 123/196 A |
| 4,834,039 | 5/1987 | Apostolides | 123/196 S |

*Primary Examiner*—E. Rollins Cross

[57] ABSTRACT

An auxiliary electrical oil pumping and draining system for internal-combustion engines operating in series with a mechanical oil pump. The system includes an adapter which is fitted in place of the standard oil filter, a first conduit which conducts oil from the adapter to an electrical oil pump, a second conduit which conducts oil from the electrical oil pump to a remote fitting for a standard oil filter, a third conduit which conducts oil from the remote fitting back to the adapter, and an electrical control for operating the pump, which control ensures that specified oil pressure is maintained in the system when the ignition key is turned on, and for a short period of time when the ignition key is turned off.

6 Claims, 2 Drawing Sheets

AUXILIARY OIL PUMPING AND DRAINING SYSTEM

BACKGROUND OF THE INVENTION

1. Field of the Invention

The present invention relates to lubrications systems, and more particularly to lubrication systems for internal combustion engines.

2. Description of the Prior Art

A large amount of friction on an internal-combustion engine occurs when the engine is first started. This is due to the fact that during the first few seconds of operation, there is insufficient oil pressure within the engine to properly lubricate the moving parts. In support of this contention, the Society of Automotive Engineers has determined that up to eighty percent of the wear on vehicle engines occurs during the first ten seconds of operation.

Various efforts to overcome this problem have included a pressurized oil reservoir mechanism and auxiliary pump mechanisms operating either in place of or in parallel to the mechanical oil pump. Pressurized oil reservoir mechanisms, typified by Pluequet et al. U.S. Pat. No. 4,453,511, suffer from unnecessary bulk and expense, and from leakage of the pressurized systems. Furthermore, such system do not lend themselves to be used as a means of draining oil from the engine. The replacement or parallel auxiliary pump mechanisms, typified by Sundles et al. U.S. Pat. No. 4,628,877, involve complex means for physical connection of the system to the oil reservoir and oil galleries. This results in unnecessary installation costs, unnecessary risk of oil leakage, unnecessary risk of metal splinters finding their way into the lubrication system, unnecessary check-valves to prevent back flow of oil, and unnecessary conduits extending below the oil pan where they can be destroyed by road hazards.

SUMMARY OF THE INVENTION

A general object and advantage of the present invention is to provide a convenient and cost effective system to minimize frictional wear of an engine of the internal-combustion type.

Another object and advantage of the present invention is to provide a convenient means by which the standard oil filter can be placed at a remote distance from the engine block to facilitate replacement of the oil filter.

Another object and advantage of the present invention is to provide a convenient means by which the standard oil filter can be held in an upright position such that dripping is minimized or eliminated when the oil filter is replaced.

Another object and advantage of the present invention is to provide a convenient means by which oil can be drained from the engine's oil reservoir without removing the oil drain plug.

In accordance with the preceding objects and advantages, the present invention uses an auxiliary electrical oil pump which is controlled by an electrical relay and oil pressure sensing device. By providing auxiliary oil pressure to the oil galleries prior to, during, and following operation of the engine, the present invention will ensure that the engine has adequate lubrication whenever there are parts in motion that require lubrication.

Further, the present invention uses an auxiliary electrical oil pump which is in serial liquid communication with the oil reservoir, mechanical oil pump, and oil galleries through an adapter mounted onto the standard oil filter fitting. By acting in series with the lubrication system, the present invention provides additional lubrication to the engine without any drilling into the oil reservoir or engine block, without requiring additional parts to extend below the oil pan, without involving any additional valves, and without at any time changing the direction of flow of oil through the oil galleries. By accessing the oil reservoir, mechanical oil pump, and oil galleries through an adapter mounted onto the standard oil filter fitting, the present invention provides additional lubrication without drilling into any part of the oil reservoir or engine block. This advantage simplifies the installation, thus maximizing convenience and minimizing cost. In addition, by acting in series with the lubrication system, the present invention utilizes the oil filter. This eliminates the added costs of an auxiliary oil filter.

Further, by removing the oil filter to a remote location, the present invention permits placement of the standard oil filter in a maximally convenient position for oil filter replacement. Another advantage is that the oil filter can be positioned so that it is an upright position and will not drip during replacement. Another advantage is that the oil reservoir can be conveniently drained through the remote oil filter fitting when the oil filter is removed. One simply removes the filter, attach a conduit to the remote oil filter fitting in place of the filter, and push a button to engage the auxiliary electrical oil pump.

BRIEF DESCRIPTION OF THE DRAWINGS

The aforementioned objects and advantages of the present invention will be appreciated from the following description and accompanying drawings wherein.

Figure 1:
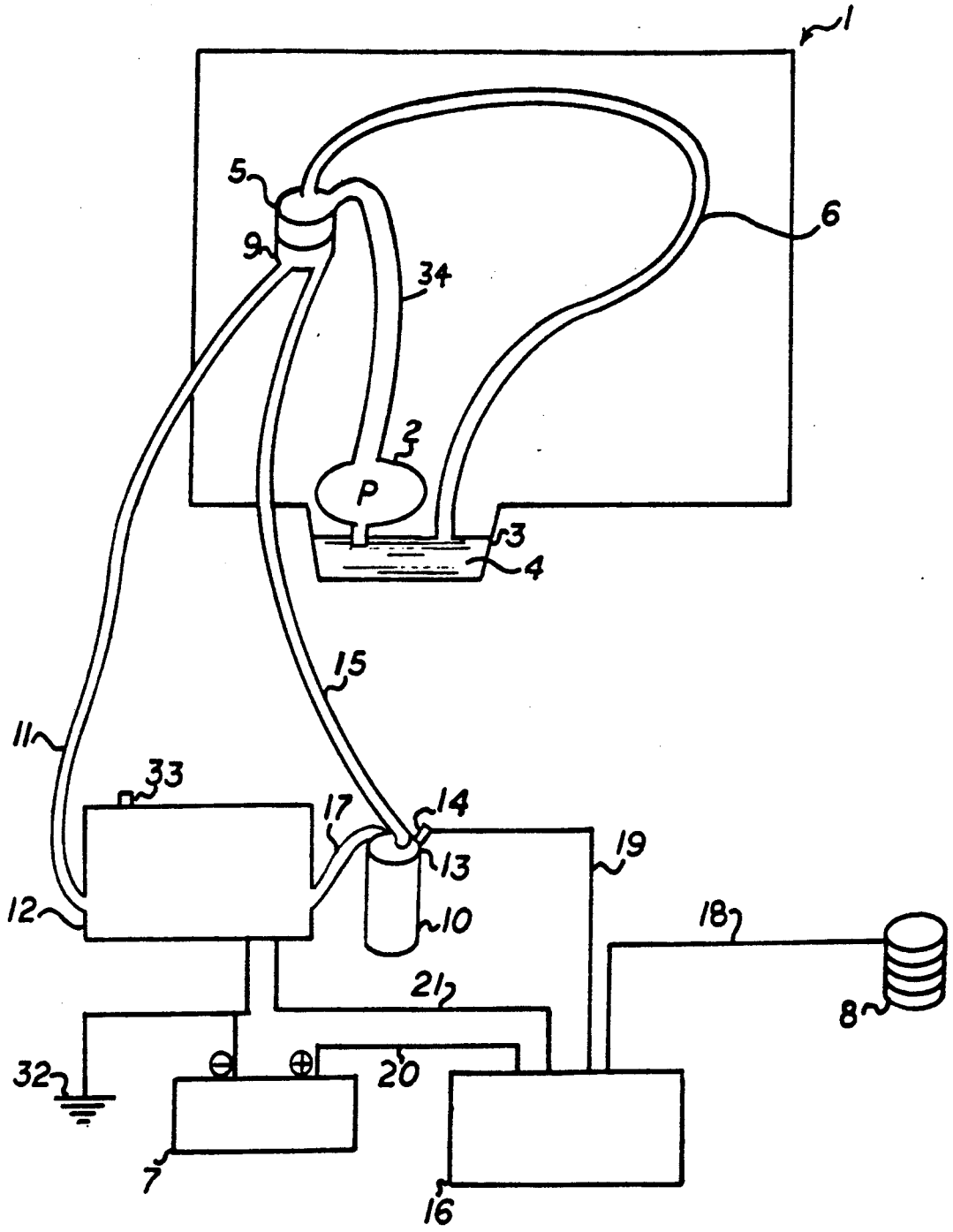
FIG. 1 shows a general schematic of the invention attached to an internal combustion engine.

DRAWING REFERENCE NUMERALS 1. internal combustion engine (shown without detail)
2. mechanical oil pump
3. oil reservoir
4. engine oil
5. standard oil filter fitting
6. oil galleries
7. battery
8. ignition coil
9. adapter
10. standard oil filter
11. first conduit
12. auxiliary electrical oil pump
13. remote oil filter fitting
14. oil pressure sensor
15. third conduit
16. electrical controller
17. second conduit
18. first electrical wire
19. second electrical wire
20. third electrical wire
21. fourth electrical wire
22. fourth conduit 23. oil receptacle
24. O-ring
25. perforations for adapter outflow
26. first passageway within adapter
27. oil filter fitting outflow
28. second passageway within adapter
29. oil filter fitting inflow
30. female threads
31. male threads
32. ground
33. test button
34. sump pump hose

DESCRIPTION OF THE PREFERRED EMBODIMENT

FIG. 1 shows the outline of an internal combustion engine 1 having a mechanical oil pump 2, an oil reservoir 3, engine oil 4, a standard oil filter fitting 5, oil galleries 6, a battery 7, and an ignition coil 8. An adapter 9 made of steel or any other suitably hard and oil resistant material is fitted in place of a standard oil filter 10. A first conduit 11 provides liquid communication between said adapter 9 and an auxiliary electrical oil pump 12. A second conduit 17 provides liquid communication between said auxiliary electrical oil pump 12 and a remote oil filter fitting 13. An oil pressure sensor 14 is mounted on said remote oil filter fitting 13. A third conduit 15 provides liquid communication between said remote oil filter fitting 13 and said adapter 9.

Said electrical oil pump is electrically grounded at ground 32. An electrical controller 16 having a test button 33, is electrically connected to said ignition coil 8 through a first electrical wire 18. Said electrical controller 16 is further electrically connected to said oil pressure sensor 14 through a second electrical wire 19. Said electrical controller 16 is further electrically connected to said battery through a third electrical wire 20. Said battery is grounded at said ground 32. Said electrical controller 16 is further electrically connected to said auxiliary electrical oil pump 12 through a fourth electrical wire 21. Said electrical controller 16 is constructed of standard, commerically available, electrical relays, the details of which are widely available and are not claimed as a part of the present invention. Said electrical controller 16 is constructed such that it senses whether an electrical current is flowing to said ignition coil 8, and also senses the oil pressure via the electrical signal coming from said oil pressure sensor 14. Further, said electrical controller 16 is constructed such that it alters the electrical current to said auxiliary electrical oil pump 12, such that sufficient oil pressure is maintained for a short time prior to, during, and for a short time following the running of the engine.

Figures 2, 3:
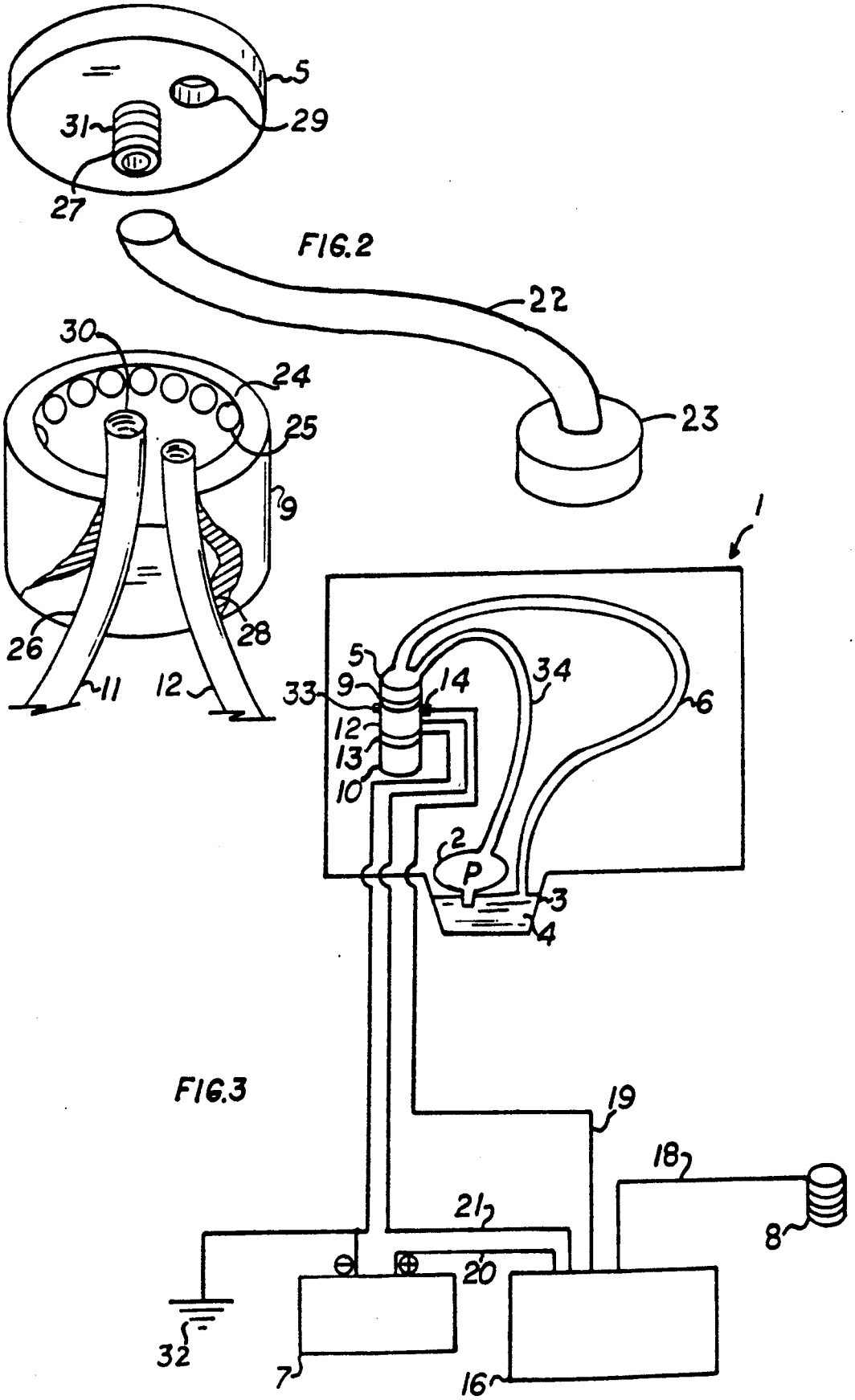
FIG. 2 shows the oil filter fitting configured with the fourth conduit and oil receptacle, and a cutaway of the adapter.
FIG. 3 shows a general schematic of a second embodiment of the invention.

In FIG. 2, a fourth conduit 22 is adapted at one end such that it will fit upon said remote oil filter fitting 13 in place of said standard oil filter 10 when said standard oil filter 10 is removed for replacement. The other end of the fourth conduit 22 is is positioned near the opening of an oil receptacle 23 to permit drainage of engine oil 4 into the oil receptacle 23. Said test button 33 is constructed such that depressing said test button 33 will engage the pumping mechanism of said auxiliary electrical oil pump 12.

FIG. 2 details the construction of said adapter 9 having an O-ring 24, a plurality of perforations 25, within the boundaries circumscribed by said O-ring 24, a first passageway 26 providing a fluid connection between the outflow 27 of said standard oil filter fitting 5 and said first conduit 11, a second passageway 28 providing a fluid connection between the inflow 29 of said standard oil filter fitting 5 and said second conduit 15, which second passageway 30 having female threads 30 to adapt to the male threads 31 of said standard oil filter fitting 5.

FIG. 2 shows an optional configuration of the present invention. Each of the parts is the same as in FIG. 1, except that, unlike FIG. 1, in which the auxiliary electrical oil pump 12, remote oil filter fitting 13 and the adapter are physically remote from each other. FIG. 2 shows a configuration in which the auxiliary electrical oil pump 12 is physically juxtaposed between the standard oil filter fitting 5 and the remote oil filter fitting 13. In other words, FIG. 2 shows a configuration in which juxtaposition is the means for coupling the auxiliary electrical oil pump 12, the remote oil filter fitting 13 and the adapter 9. This is a logical extreme of having the first, second and third conduits 11, 17, and 15 of exceedingly short length.

OPERATION OF THE DEVICE

Under normal operation, either said mechanical oil pump 2 or said auxiliary electrical oil pump 12, or both, are in operation, said engine oil 4 flows in sequence from said oil reservoir 3, through said mechanical oil pump 2, through said standard oil filter fitting 5, through said adapter 9, through said first conduit 11, through said auxiliary electrical oil pump 12, through said second conduit 17, through said remote oil filter fitting 13, through said standard oil filter 10, through said third conduit 15, again through said adapter 9, again through said standard oil filter fitting 5, through said oil galleries 6 and returns to said oil reservoir 3.

When draining oil from the oil reservoir, said fourth conduit 22 is fitted onto said remote oil filter fitting 13 and said test button 33 is depressed, said engine oil 4 flows in sequence from said oil reservoir 3, through said mechanical oil pump 2, through said standard oil filter fitting 5, through said adapter 9, through said first conduit 11, through said auxiliary electrical oil pump 12, through said second conduit 17, through said remote oil filter fitting 13, through said fourth conduit 22 and into an oil receptacle 23.

CONCLUSION

The present invention is a significant improvement over the teachings of prior art in lubrication systems for internal combustion engines. The major improvements involve (1) connecting the auxiliary pump in series with the mechanical pump instead of in parallel, (2) utilizing the standard oil filter fitting as the sole access to the existing oil pressure system, and (3) utilizing a remote oil filter fitting.

ADDITIONAL EMBODIMENTS

The presently described invention is not limited to automotive internal combustion engines, but is equally applicable to any device, (including turbochargers) which relys upon a mechanical oil pump for lubrication. The present invention is described as having a pressure sensing device mounted on the remote oil filter fitting, but such pressure sensing device can be installed at any other point along the oil flow which is pressurized during operation of the engine. The present invention is described as having a test button mounted on the electrical oil pump, but such test button can be mounted on the remote oil filter fitting, on the electrical controller, or elsewhere near the engine. The present invention is described as having an electrical connection to the electrical coil to sense whether or not the engine is in operation, but the present invention could perform the same operation by electrical connection to the ignition wire or other electrical wires to which voltage is supplied when the engine is turned on.

I claim:

1. In combination with an internal combustion engine having a standard oil filter fitting and an electrical power source, an auxiliary oil pumping and draining system comprising:

an adapter which is sized and dimensioned to attach to the standard oil filter fitting in place of a standard oil filter;

an electrical oil pump in liquid communication with said adapter;

a first means for coupling said adapter with said electrical oil pump;

a second oil filter fitting which is sized and dimensioned to attach to the standard oil filter;

a second means for coupling said electrical oil pump with said remote oil filter fitting;

a third means for coupling said remote oil filter fitting with said adapter;

an electrical control means for energizing said electrical pump with electricity from said electrical power source.

2. The system according to claim 1, in which the electrical oil pump operates in series with a mechanical oil pump.

3. The system according to claim 2, further comprising a fourth means for removably coupling said remote oil filter fitting to an external oil disposal container.

4. The system according to claim 1, wherein the means for energizing said electrical pump comprises a means for sensing voltage in an ignition wire.

5. The system according to claim 1, wherein the means for energizing said electrical pump comprises a pressure sensor.

6. The system according to claim 1, wherein the means for energizing said electrical pump comprises a test switch.

* * * * *